United States Patent [19]

Tsukahara et al.

[11] 4,226,088

[45] Oct. 7, 1980

[54] GAS TURBINE COMBUSTOR

[75] Inventors: Satoshi Tsukahara; Isao Sato; Yoshihiro Uchiyama; Masanobu Kusaba, all of Hitachi, Japan

[73] Assignee: Hitachi, Ltd., Japan

[21] Appl. No.: 880,109

[22] Filed: Feb. 22, 1978

[30] Foreign Application Priority Data

Feb. 23, 1977 [JP] Japan ..... 52-18116

[51] Int. Cl.[3] ..... F02C 7/22

[52] U.S. Cl. ..... 60/752; 60/DIG. 11

[58] Field of Search ..... 60/39.65, 39.74 R, 39.74 B; 431/352, 353

[56] References Cited

U.S. PATENT DOCUMENTS

| | | | |
|---|---|---|---|
| 3,608,309 | 9/1971 | Hill et al. | 431/352 |
| 3,874,169 | 4/1975 | Andersson et al. | 60/39.65 |
| 3,899,882 | 8/1975 | Parker | 60/39.65 |
| 3,927,835 | 12/1975 | Gerrard | 60/39.74 R |
| 4,007,001 | 2/1977 | Schirmer et al. | 60/39.65 |
| 4,054,028 | 10/1977 | Kawaguchi | 431/10 |
| 4,087,963 | 5/1978 | Schirmer | 431/352 |

FOREIGN PATENT DOCUMENTS

| | | | |
|---|---|---|---|
| 2737773 | 1/1978 | Fed. Rep. of Germany | 60/39.65 |

*Primary Examiner*—Robert E. Garrett

*Attorney, Agent, or Firm*—Craig & Antonelli

[57] ABSTRACT

A combustor for gas turbines includes a stepped cylindrical tube defining first, second and main combustion spaces. Primary air supply openings are formed in the tube portion defining the first combustion space, secondary air supply openings in the tube portion defining the second combustion space, and diluting air supply openings in the tube portion defining the main combustion space. To achieve effective cooling of the combustion gas within the combustion chamber, particularly in the second combustion space, and especially in the central portion thereof, and at the same time to maintain a stable combustion, the tube is formed so, and the cross-sectional areas of the primary, secondary and diluting air supply openings are dimensioned so, that 25 to 32% of the total amount of air supplied to the combustion chamber are used as primary air in the first combustion space, 38 to 50% as secondary air in the second combustion space, and less than 30% as diluting air in the main combustion space.

6 Claims, 2 Drawing Figures

GAS TURBINE COMBUSTOR

BACKGROUND AND SUMMARY OF THE INVENTION

This invention relates to a combustor for gas turbines.

It is known that $NO_x$ (nitrogen oxides) is produced during combustion by the reaction of oxygen and nitrogen present in the atmosphere, and that this reaction may be reduced by a low-oxygen combustion at low temperatures.

In a co-pending application for Letters Patent of the United States, Ser. No. 828,100, filed Aug. 22, 1977, combustor for gas turbines is described which comprises a cylindrical tube and a front inner tube disposed coaxially within the cylindrical tube and cooperating therewith to define a combustion chamber, a nozzle for injecting the fuel into the combustion chamber, means for creating a swirling stream of the air within the combustion chamber, the front inner tube having a continuously or stepwise increasing diameter from the nozzle towards the downstream side of the combustion chamber, the larger end of the front inner tube being in sliding engagement with the inner surface of the cylindrical tube. The front inner tube and the cylindrical tube are provided with a plurality of air supply openings. 0.8 to 1.2 times the theoretical amount of air (Ao) is fed through primary air supply openings and 1.7 Ao to 2.5 Ao is fed through the secondary air supply openings, while 2.0 Ao to 2.7 Ao is supplied as diluting air to the downstream area of the combustion chamber.

One essential disadvantage of that combustor for gas turbines resides in the fact that due to insufficient cooling of the combustion gas in the portion of the combustion chamber along the central axis thereof, the production of $NO_x$ cannot sufficiently and effectively be reduced. The major portion of the air fed into the combustion chamber through the air supply openings provided in the front inner tube flows along and close to the interior wall of the front inner tube, while only a small portion of the air will reach the central axis of the combustion chamber to cool the combustion gases in that zone. As a result, the central portion of the combustion chamber is left at high temperatures so that large amounts of $NO_x$ are produced.

Another essential disadvantage of the combustor referred to above is the fact that the amount of air supplied through the openings in the front inner tube is insufficient effectively to cool the combustion gas within the front inner tube. As mentioned above, 1.7 Ao to 2.5 Ao is fed through the secondary air supply channels into the zone within the front inner tube while 2.0 Ao to 2.7 Ao is supplied as diluting air into the downstream zone of the combustion chamber. As a result of such insufficient supply of air through the secondary supply openings, the production of $NO_x$ is enhanced.

It is therefore an object of the invention to provide a combustor for gas turbines in which the production of $NO_x$ gases is considerably reduced.

Another object of the invention is to provide a combustor in which the production of CO is kept at a low value.

Another object of the invention is to provide a combustor in which the combustion is stabilized.

A combustor for gas turbines according to the present invention comprises a generally cylindrical tube means defining a central axis and a combustion chamber including first, second and main combustion spaces, the portion of the tube means defining the first combustion space having a plurality of primary air supply openings, means causing a swirling stream of the primary air, and nozzle means disposed at an end of the tube means for supplying fuel to the first combustion space along the central axis, the portion of the tube means defining the second combustion space having a greater diameter than the portion defining the first combustion space and including a plurality of secondary air supply openings, and the portion of the tube means defining the main combustion space having a greater diameter than the portion defining the second combustion space and including a plurality of diluting air supply openings, wherein the tube means are so formed that the secondary air fed through the secondary air supply openings reaches the portion of the combustion chamber adjacent the central axis. The combustion gas will thus be effectively cooled even within the central portion of the combustion chamber so that the production of $NO_x$ gases is effectively reduced.

In a preferred embodiment of the invention, the primary air supplied to the first combustion space is between about 25 and about 32% of the total air supplied to the combustion chamber, the secondary air supplied to the second combustion space is between about 38 and about 50% of the total air, and the diluting air supplied to the main combustion space is below about 30% of the total air. Such distribution to the individual combustion spaces not only reduces the production of undesired $NO_x$ gases but at the same time supports a stable combustion within the combustion chamber.

The above and further objects, features and advantages of the present invention will become more apparent from the following description when taken in connection with the accompanying drawings which show, for the purpose of illustration only, one preferred embodiment of the invention.

BRIEF DESCRIPTION OF THE DRAWING

FIG. 1 is a diagrammatic sectional view of a portion of a combustor for gas turbines according to the preferred embodiment of the invention, while

DETAILED DESCRIPTION OF THE PREFERRED EMBODIMENT

Figure 1:
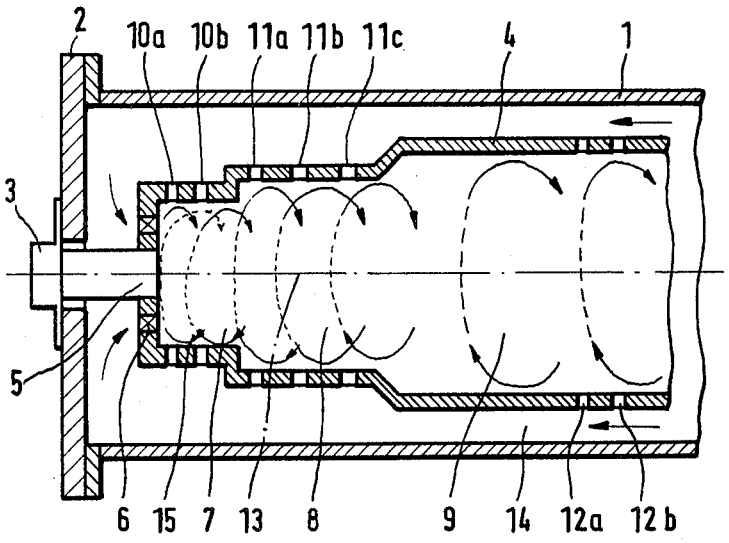

The combustor for gas turbines shown in FIG. 1 comprises a cylindrical outer housing 1 sealed in an air-tight manner by an end plate 2. The end plate 2 has a central hole in which a nozzle 3 for supplying fuel to the combustion chamber is mounted to extend into the housing 1. An inner tube 4 is disposed coaxially with the cylindrical outer housing 1. The inner end 5 of the nozzle 3 is connected in a sealed manner to a central hole provided in an end plate of the inner tube 4. Also provided in that end plate of the inner tube 4 is a swirl vane 6 for injecting pressurized air into the combustion chamber proper defined by the tube 4 and for causing a swirl stream of the air within the combustion chamber.

The combustion chamber defined by the inner tube 4 includes a first combustion space 7, a second combustion space 8, and a main combustion space 9. The tubular wall confining the first combustion space 7 has a plurality of primary air supply openings **10*a*, 10*b*, the tubular portion confining the second combustion space 8 has a plurality of secondary air supply openings 11***a*, 11*b*, 11*c*, and the tubular wall confining the main combustion space 9 has a plurality of diluting air supply openings 12*a*, 12*b*. The diameter of the first combustion space 7 is smaller than that of the second combustion space 8, which in turn is smaller than the diameter of the main combustion space 9, so as to minimize the pressure loss between the first and second combustion spaces 7, 8.

The center portion 13 of the combustion chamber along the central axis of the inner tube 4 is the zone of highest temperature of the combustion gas. The inner tube 4 is so formed that the air supplied to each combustion space through the respective air supply openings reaches the center portion 13 so that the combustion gas in this zone is effectively cooled and the production of $NO_x$ is reduced. The secondary air supply openings 11*a*, 11*b*, 11*c* may be located and sized so that the secondary air flows therethrough at such a velocity that the secondary air reaches the center portion 13.

The diameter of each air supply opening for each combustion space may be determined in accordance with the following equation:

$$Y=2.2(\rho j\ Vj/\rho g\ Vg-0.1)^{0.68}\cdot D,$$

wherein

Y = distance of the air supply opening from the central axis;

D = diameter of the air supply opening;

Vj = air velocity through the opening;

$\rho$j = air density;

Vg = velocity of the combustion gas;

$\rho$g = density of the combustion gas.

The air supply openings for each combustion space are sized so that the ratio of the total cross-sectional areas of the openings for each combustion space equals the ratio of the amount of air required by each combustion space.

An air passage 14 for feeding the air to the air supply openings is formed between the cylindrical housing 1 and the coaxial inner tube 4.

The operation of the above described combustor is as follows: fuel is injected through the nozzle 3 into the first combustion space 7, and pressurized air flowing through the air passage 14 is simultaneously introduced into the first combustion space 7 past the swirl vane 6 and the primary air supply openings 10*a*, 10*b*. At the same time, pressurized air is supplied to the second combustion space 8 through the secondary air supply openings 11*a*, 11*b*, 11*c*.

The fuel and air injected into the first combustion space 7 are mixed and gasified there. The gasified mixture is ignited within the first combustion space 7 by a spark produced by an ignition device (not shown). The flame is maintained by the recirculation created by the vortex or swirling stream 15 which flows from the environment of the secondary air supply opening 11*a*, 11*b*, 11*c* to the nozzle 3, so that the combustion continues in the first combustion space 7.

The total amount of air supplied to the first combustion space 7 is about equal to the theoretical amount of air required for the total fuel. The temperature of the combustion gas within the first combustion space 7 is relatively low and the volume of the combustion gas is relatively small because both the gasification and the combustion of the fuel take place in the first combustion space 7. The combustion is continued in the second combustion space 8 by the air supplied through the secondary air supply openings 11*a*, 11*b*, 11*c*, where the volume of the combustion gas increases.

Since the diameter of the second combustion space 8 is greater than that of the first combustion space 7, the velocity of the combustion gas diminuishes in the second combustion space, thereby reducing the loss of pressure of the combustion gas within the combustion chamber. The pressure difference between the inner and outer side of the secondary air supply openings 11*a*, 11*b*, 11*c* is thereby increased so that the secondary air is easier to introduce into the second combustion space 8. The combustion gas reaches high temperatures within the second combustion space 8 and its maximum temperature in the center portion 13 thereof. However, the combustion gas is effectively and sufficiently cooled by the secondary air because the inner tube 4 is formed so that the secondary air reaches the central axis, and the secondary air supply openings 11*a*, 11*b*, 11*c* are also formed so that the secondary air flows through those openings at a velocity sufficient for the secondary air to reach the central axis.

The structure of the inner tube 4 thus allows a sufficient and effective cooling of the high-temperature combustion gas in the second combustion space 8, particularly in the central portion 13 thereof, whereby the production of $NO_x$ is prevented.

In the main combustion space 9, the unburnt gas is perfectly combusted. The combustion gas is delivered to the gas turbine (not shown) by the air which is supplied to the main combustion space 9 through the openings 12*a* and 12*b* for diluting and cooling the combustion gas.

The production of $NO_x$ in the first combustion space 7 is reduced by increasing the total amounts of primary air supplied to the first combustion space 7. However, the stability of the combustion is lost when the amount of primary air becomes excessive.

The production of $NO_x$ in the second combustion space 8 is reduced by increasing the total amount of secondary air because the cooling of the combustion gas is performed more effectively. However, vibrations of the combustion in the second combustion space 8 occur when the amount of secondary air becomes excessive.

The production of $NO_x$ and the stability of the combustion are thus influenced only by the amounts of primary and secondary air because $NO_x$ is produced only in the combustion spaces 7 and 8, while almost no $NO_x$ is produced in the dilution zone of the main combustion space 9 where the temperature of the combustion gas is low.

Figure 2:
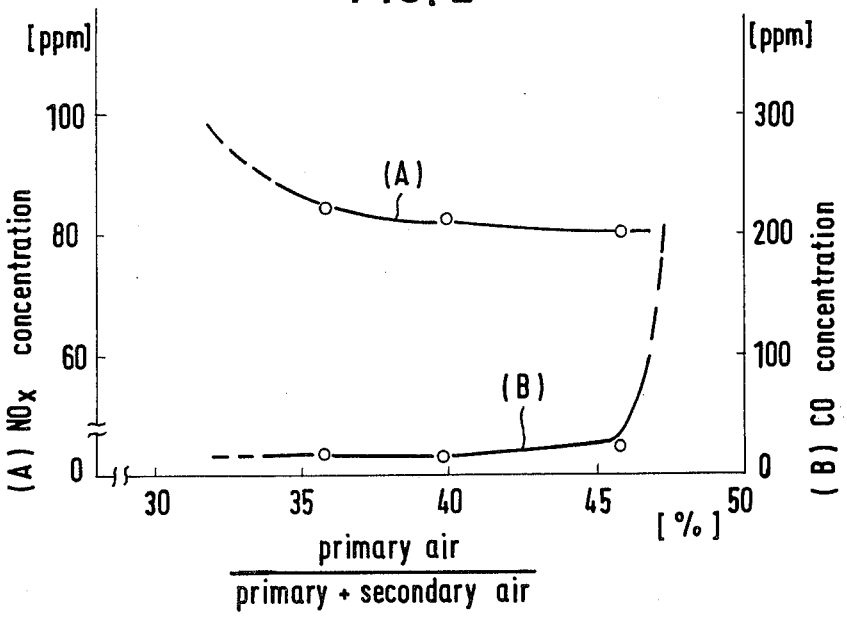
FIG. 2 is a graph illustrating the concentration of $NO_x$ and CO as functions of the air distribution in the combustion chamber.

In the graph of FIG. 2 the ratio of the amount of primary air to the total amount of primary and secondary air is depicted in per-cent on the abscissa, while the left hand ordinate shows the concentration of $NO_x$ and the right hand ordinate that of CO in ppm. Curve (A) in FIG. 2 represents the relationship between the $NO_x$ concentration and the ratio of the amount of primary air to the total amount of primary and secondary air, while curve (B) shows the same relationship for the CO concentration, under the condition that 27 to 30% of the total amount of air supplied to the combustion chamber is used for diluting the combustion gas within the main combustion space 9, while the balance is used as primary and secondary air. The stability of the combustion depends on the CO concentration.

When the ratio of the amount of primary air to the total amount of primary and secondary air is increased, the $NO_x$ concentration is reduced according to curve (A) in FIG. 2. At a ratio of 45%, however, the CO concentration increases suddenly, which is an indication of the combustion becoming instable. This value of 45% means that 32% of the total amount of air supplied to the combustion chamber is used as primary air, 38% as secondary air and 30% as diluting air, in which case the production of $NO_x$ is reduced by 17.5%, in comparison with conventional combustors.

When 29% of the total amount of air supplied to the combustion chamber is used as primary air, 44% as secondary air and the remaining 27% as diluting air, the $NO_x$ production can be reduced by 15%, as an experiment has shown. According to another experiment, when 25% of the total amount of air is used as primary air, 45% as secondary air and 30% as diluting air, the production of $NO_x$ may be reduced by 13% over conventional combustors.

When the primary air is less than 25% of the total air, no sufficient cooling of the combustion gas in the first combustion space 7 is achieved, and the $NO_x$ concentration increases. On the other hand, when more than 35% of the total air is used as primary air, the combustion in the first combustion space 7 becomes instable and the flame is extinguished by the sudden increase of the CO concentration.

A further experiment has shown that the performance of the combustion is not deteriorated and the $NO_x$ concentration is not increased even if 50% of the total amount of air is used as secondary air. Above this value, however, vibrations of the combustion will occur. On the other hand, if less than 38% of the total amount of air is used as secondary air, the $NO_x$ concentration increases because no sufficient cooling of the combustion gas within the second combustion space takes place due to insufficient supply of cooling air.

The amount of diluting air depends on the total amount of primary and secondary air. If less than 30% of the total amount of air supplied to the combustion chamber is used as diluting air, the combustion in the main combustion chamber can take place. Above that value, however, the combustion is insufficient because the amount of air to be used as primary and secondary air diminuishes and the combustion gas cannot be sufficiently cooled within the first and second combustion spaces 7 and 8.

By using 25 to 32% of the total amount of air supplied to the combustion chamber as primary air, 38 to 50% as secondary air and less than 30% as diluting air, effective reduction of the $NO_x$ production as well as a stabilization of the combustion in the combustion chamber are achieved. Accordingly, the primary air supply openings 10*a*, 10*b* are formed so as to pass 25 to 32% of the total air, the secondary air supply openings 11*a*, 11*b*, 11*c* are formed so as to pass 38 to 50% of the total air, and the diluting air supply openings 12*a*, 12*b* are formed so as to pass less than 30% of the total amount of air, in accordance with the amounts of air required in each combustion space 7, 8 and 9, respectively.

We claim:

1. A combustor for gas turbines comprising:

an outer housing having an end plate, a combustion chamber disposed in said outer housing and including a first combustion section having an end member disposed near the end plate of said outer housing, a second combustion section having a larger diameter than that of the first combustion section and adjoining therewith, and a main combustion section having a larger diameter than that of the second combustion section and connected therewith, an air passage formed between said outer housing and said cylindrical combustion chamber, a plurality of primary air supply openings formed through a wall of the first combustion section, and defined so that air introduced into the first combustion section is in the range of about 25 to about 32% of the total amount of air supplied to said combustion chamber, a swirl member provided at the end member of the first combustion section, a nozzle member provided at the end plate of said outer housing extending into the first combustion section for supplying fuel to the first combustion section, a plurality of secondary air supply openings formed through the wall of the second combustion section, and defined so that air introduced therethrough into the second combustion section as secondary air is in the range of about 38 to about 50% of the total amount of air supplied to said combustion chamber, and a plurality of diluting air supply openings formed through a wall of the main combustion section of said combustion chamber, and defined so that air introduced therethrough into the main combustion section is in the range of below about 30% of the total amount of air supplied to said combustion chamber.

2. A combustor according to claim 1, wherein the secondary air supply openings are formed and defined so that the secondary air reaches to the longitudinal axis of the secondary combustion section.

3. A combustor according to claim 1, wherein the ratio of the cross sectional area of said respective air supply openings of the respective combustion sections to that of the total air supply openings of said combustion chamber is defined to be proportional to the ratio of the amount of air required by the respective combustion sections to the total amount of air supplied to said combustion chamber.

4. The combustor of claims 1 or 3, wherein the cross sectional area of said primary air supply openings is defined to be 25 to 32% of that of the total air supply openings formed through said combustion chamber, the cross sectional area of said secondary air supply openings is defined to be 38 to 50% of that of the total air supply openings formed through said combustion chamber, and the cross sectional area of said diluting air supply openings is defined to be less than 30% of that of the total air supply openings formed through said combustion chamber.

5. A combustor according to claims 1, 2 or 3, wherein the diameters of respective air supply openings of respective combustion sections are determined in accordance with the following equation:

$$Y=2.2(\rho_j V_j/\rho_g V_g-0.1)^{0.68}\cdot D,$$

wherein

Y = distance to the air supply opening from the longitudinal axis of the combustion chamber;

D = diameter of the air supply opening;

$V_j$ = air velocity through the opening;

$\rho_j$ = air density;

$V_g$ = velocity of the combustion gas;

$\rho_g$ = density of the combustion gas.

6. A combustor according to claim 1, wherein said combustion chamber is of a stepped cylindrical configuration.

* * * * *